US010047491B2

(12) United States Patent
Kim et al.

(10) Patent No.: US 10,047,491 B2
(45) Date of Patent: Aug. 14, 2018

(54) GROUND REINFORCEMENT STRUCTURE AND CONSTRUCTION METHOD THEREOF

(71) Applicant: KOLON GLOBAL CORPORATION, Gwacheon-si, Gyeonggi-do (KR)

(72) Inventors: Kyoung Chul Kim, Seoul (KR); Se Jin Kim, Yongin-si (KR); Sung Gon Son, Anyang-si (KR); Jae Seo Choi, Uiwang-si (KR); Sang Heon Choi, Suwon-si (KR)

(73) Assignee: KOLON GLOBAL CORPORATION, Gwacheon-si, Gyeonggi-Do (KR)

( * ) Notice: Subject to any disclaimer, the term of this patent is extended or adjusted under 35 U.S.C. 154(b) by 0 days.

(21) Appl. No.: 15/384,554

(22) Filed: Dec. 20, 2016

(65) Prior Publication Data

US 2018/0100280 A1 Apr. 12, 2018

(30) Foreign Application Priority Data

Oct. 7, 2016 (KR) ..... 10-2016-0129848

(51) Int. Cl.
*E02D 5/80* (2006.01)
*E21D 20/02* (2006.01)
*E21D 21/00* (2006.01)

(52) U.S. Cl.
CPC ..... *E02D 5/805* (2013.01); *E02D 5/80* (2013.01); *E02D 5/808* (2013.01);
(Continued)

(58) Field of Classification Search
CPC ..... E21D 20/02; E21D 20/021; E21D 20/025; E21D 20/028; E21D 21/0006;
(Continued)

(56) References Cited

U.S. PATENT DOCUMENTS 4,091,882 A * 5/1978 Hashimoto ..... B23B 51/0045 175/286
4,459,067 A * 7/1984 Skogberg ..... E02D 5/805 405/259.3

(Continued)

FOREIGN PATENT DOCUMENTS

JP 7-62654 3/1995
KR 10-2005-0079166 8/2005

*Primary Examiner* — Frederick L Lagman
(74) *Attorney, Agent, or Firm* — Kile Park Reed & Houtteman PLLC

(57) ABSTRACT

Provided is a ground reinforcement structure installed on a ground (10) in which a sandy soil layer (11) having a weak surface layer is provided and thus large-caliber excavation is difficult to be performed, the ground reinforcement structure including a ground reinforcement material (100) including: an expansion-type steel pipe (110) inserted to be installed in a small-caliber drilled portion (A) having a diameter of 51 mm to 61 mm and expanded by hydraulic pressure; and a settlement member (120) coupled to a rear end of the expansion-type steel pipe (110). Here, the expansion-type steel pipe (110) is inserted into the sandy soil layer (11), and the settlement member (120) is inserted into a rock layer (12). In this case, the settlement member (120) of the ground reinforcement structure according to the present invention is fixed to the rock layer (12), fixing force is excellent.

4 Claims, 9 Drawing Sheets

(52) U.S. Cl.
CPC ..... *E02D 2250/003* (2013.01); *E02D 2250/0038* (2013.01); *E02D 2300/002* (2013.01); *E02D 2600/30* (2013.01); *E21D 20/02* (2013.01); *E21D 21/0073* (2016.01)

(58) Field of Classification Search
CPC ..... E21D 21/0073; E21D 21/008; E02D 5/80; E02D 5/801; E02D 5/803; E02D 5/805; E02D 5/808
USPC ..... 405/259.3
See application file for complete search history.

(56) References Cited

U.S. PATENT DOCUMENTS 4,768,900 A * 9/1988 Burland ..... E02D 5/54 405/232
5,240,353 A * 8/1993 Bower ..... B63B 21/26 405/259.1
5,387,060 A * 2/1995 Locotos ..... E21D 21/0026 405/259.3
5,525,013 A * 6/1996 Seegmiller ..... E21D 11/006 405/259.3
5,636,945 A * 6/1997 Nes ..... E21D 21/0086 405/259.1
6,428,243 B1 * 8/2002 Hutchins ..... E21D 20/02 405/259.1
7,963,725 B2 * 6/2011 Dawe ..... E21D 21/004 405/259.1
8,678,729 B2 * 3/2014 Salgado ..... F16B 13/066 405/259.5
2008/0110640 A1 * 5/2008 Bernthaler ..... E02D 5/76 166/382
2009/0052995 A1 * 2/2009 Eriksson ..... E21D 20/028 405/259.5
2009/0297279 A1 * 12/2009 Weaver ..... E21D 21/0026 405/259.1
2010/0003088 A1 * 1/2010 Grocholewski ..... E02D 5/808 405/259.5
2011/0135402 A1 * 6/2011 Leppanen ..... E21D 21/008 405/259.2
2011/0299939 A1 * 12/2011 Craven ..... E21D 21/0033 405/259.3
2013/0202364 A1 * 8/2013 Ikuno ..... E21D 21/008 405/259.3
2014/0037388 A1 * 2/2014 Ahola ..... E21D 20/02 405/259.3
2015/0322785 A1 * 11/2015 Ahola ..... E21D 20/028 405/259.3

* cited by examiner

GROUND REINFORCEMENT STRUCTURE AND CONSTRUCTION METHOD THEREOF

CROSS-REFERENCE TO RELATED APPLICATIONS

This U.S. non-provisional patent application claims priority under 35 U.S.C. § 119 of Korean Patent Application No. 10-2016-0129848, filed on Oct. 7, 2016, the entire contents of which are hereby incorporated by reference.

BACKGROUND

The present invention herein relates to a construction field, and more particularly, to a ground reinforcement structure and a construction method thereof.

A ground reinforcement structure is installed to increase stiffness of a ground (e.g., a slope, a tunnel, a temporary facility for retaining soil, etc.). The ground reinforcement structure is installed through a process of drilling the ground with a diameter of about 110 mm and inserting a ground reinforcing material into a drilled portion.

A typical ground reinforcement structure is formed by inserting a steel pipe, a steel bar, and a rebar into the drilled portion and filling grout into the drilled portion. However, the above-described process is difficult to be applied to the ground formed by a sandy soil layer having a weak surface layer.

First, when the ground reinforcement structure inserted into and fixed to the weak sandy soil layer is installed, the ground may be deformed to lose settling force.

Especially, when the grout is filled, the weak sandy soil layer is collapsed to lose fixing force.

Furthermore, since while the diameter of the drilled hole, which is about 110 mm, is wide, but a diameter of an anchor body including a steel pipe, a steel bar, and a rebar is narrow, the settling force is weak, and the drilled hole is easily collapsed.

SUMMARY

The present invention provides a ground reinforcement structure capable of minimizing a diameter of a drilled hole of a ground and enhancing stiffness of the ground by coupling a weak sandy soil layer to a rock layer and a construction method thereof to solve the above-described limitation.

An embodiment of the present invention provides a ground reinforcement structure installed on a ground 10 in which a sandy soil layer 11 having a weak surface layer is provided and thus large-caliber excavation is difficult to be performed, the ground reinforcement structure including a ground reinforcement member 100 including: an expansion-type steel pipe 110 inserted to be installed in a small-caliber drilled portion A having a diameter of 51 mm to 61 mm and expanded by hydraulic pressure; and a settlement member 120 coupled to a rear end of the expansion-type steel pipe 110. Here, the expansion-type steel pipe 110 is inserted into the sandy soil layer 11, and the settlement member 120 is inserted into a rock layer 12.

In an embodiment, the ground reinforcement structure may include the expansion-type steel pipe 110 having a diameter gradually decreasing from a front end to a rear end thereof.

In an embodiment, the expansion-type steel pipe 110 may desirably have the diameter gradually decreasing from a front end to a rear end thereof In an embodiment, a grout injection pipe 210 may be desirably coupled along an outer circumferential surface of the ground reinforcement member 100 to fill grout 200 into a gap between the drilled portion A and the ground reinforcement member 100.

In an embodiment, the ground reinforcement structure may desirably further include a packing part 130 installed on an outer circumferential surface of the expansion-type steel pipe 110 to block an inlet of the drilled portion A to prevent the grout 200 from flowing to the outside of the drilled portion while the grout 200 is filled.

In an embodiment, the packing part 130 may desirably include: a through-hole 131 passing through the injection pipe 210; and a grout discharge hole 132 for checking discharge of the grout 200 that is completely filled.

In an embodiment, the settlement member 120 may be desirably made of a cable, steel fiber, high strength plastic, a steel bar, and a steel pipe.

In an embodiment, the settlement member may be desirably made of a steel pipe, a grout introduction hole may be desirably defined in an outer circumferential surface of the settlement member 120, and the grout 200 injected through the grout injection pipe 210 installed along the outer circumferential surfaces of the expansion-type steel pipe 110 and the settlement member 120 may be desirably filled in the drilled portion A and an outside of the combined ground reinforcement member 100, and filled in an inside of the settlement member 120 through the introduction hole 121.

In an embodiment, the settlement member 120 may be desirably made of a steel bar, and a screw 122 may be desirably provided along an outer circumferential surface of the steel bar.

In an embodiment, a method of installing the ground reinforcement structure, the method may include: a ground drilling process of defining the drilled portion A having a diameter of 51 mm to 61 mm up to the rock layer 12; a ground reinforcement member installation process of installing the ground reinforcement member 100 to insert the settlement member 120 into the rock layer 12; a grout filling process of filling the grout 200 into the gap between the drilled portion A and the ground reinforcement member 100; and an expansion-type steel pipe expansion process of expanding the expansion-type steel pipe 110 by using hydraulic pressure.

In an embodiment, a method of installing the ground reinforcement structure, the method may include: a ground drilling process of defining the drilled portion A having a diameter of 51 mm to 61 mm up to the rock layer 12; a ground reinforcement member installation process of installing the ground reinforcement member 100 to insert the settlement member 120 into the rock layer 12; a grout filling process of filling the grout 200 into a gap between the drilled portion A and the ground reinforcement member 100 and the inside of the settlement member 120; and an expansion-type steel pipe expansion process of expanding the expansion-type steel pipe 110 by using hydraulic pressure.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Hereinafter, embodiments of the present invention are described in more detail with reference to the accompanying drawings and, while describing of the accompanying drawings, the same or corresponding components are given with the same drawing number. Therefore, its overlapping description will be omitted.

Also, though terms like a first and a second are used to describe various members, components, regions, layers, and/or portions in various embodiments of the present invention, the members, components, regions, layers, and/or portions are not limited to these terms.

When it is described that an element is "coupled to", "engaged with", or "connected to" another element, it should be understood that the element may be directly coupled or connected to the other element but still another element may be "coupled to", "engaged with", or "connected to" the other element between them.

Hereinafter, with reference to the attached tables and drawings, a ground reinforcement structure according to an embodiment of the present invention and a construction method thereof will be described in detail.

Figure 1:
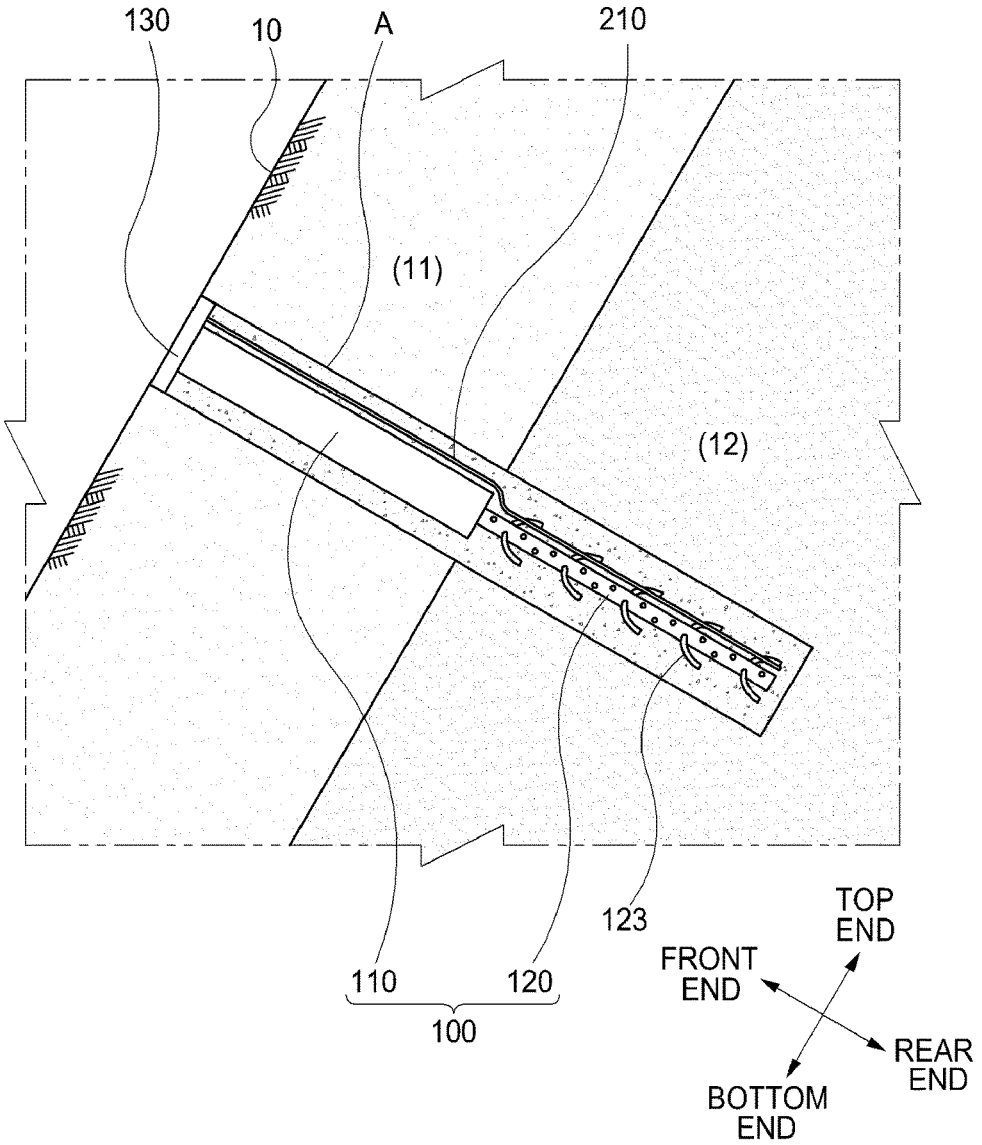
FIG. 1 is a side view illustrating an installed ground reinforcement structure according to an embodiment of the present invention.
Figure 2:
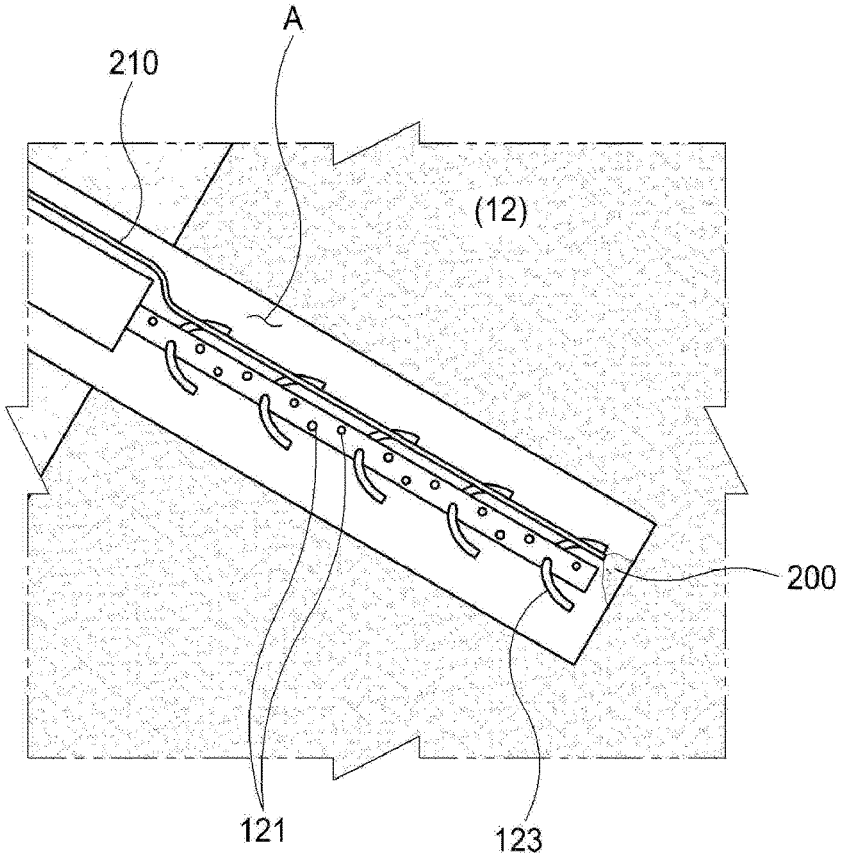
FIG. 2 is a side view illustrating a settlement member according to an embodiment of the present invention.

Front-rear and top-bottom directions will be defined by directions indicated in FIG. 1.

According to the present invention, the ground reinforcement structure may be installed even on a ground 10, in which a weak sandy soil layer 11 having a weak surface layer is provided and thus large-caliber excavation is difficult to be performed. The ground reinforcement structure includes a ground reinforcing material 100 including: an expansion-type steel pipe 110 inserted to be installed in a small-caliber drilled portion A having a diameter of 51 mm to 61 mm and expanded by hydraulic pressure; and a settlement member 120 coupled to a rear end of the expansion-type steel pipe 110. Here, the expansion-type steel pipe 110 is inserted into the sandy soil layer 11, and the settlement member 120 is inserted into a rock layer 12.

In this case, the ground reinforcement structure according to the present invention is a combined-type ground reinforcement member in which the expansion-type steel pipe 110 and the settlement member 120 having a diameter less than that of the expansion-type steel pipe are coupled to each other to maximize a ground reinforcement effect.

First, since the ground reinforcement structure according to the present invention includes the settlement member 120 fixed to the rock layer 12, fixing force is excellent.

Also, in the ground reinforcement structure according to the present invention, since the drilled portion has a small-caliber and the expansion-type steel pipe expanding to prevent a gap from being generated in a drilling diameter after expanded, a ground effect may be generated just after the expansion of the expansion-type steel pipe to prevent the drilled portion from being collapsed.

Since the present invention generates an effect of pressing grout while the expansion-type steel pipe 110 is expanded, the grout filled around the settlement member 120 is further firmed, and the grout is filled in a crack of the drilled portion and an inside of the settlement member 120.

In addition, since the settlement member 120 of the ground reinforcement structure according to the present invention is installed at a central portion of the drilled portion while the expansion-type steel pipe is expanded, an additional spacer for installing the settlement member at the central portion is unnecessary.

The expansion-type steel pipe 110 desirably has a diameter gradually decreasing from a front end to a rear end thereof.

Figure 10:
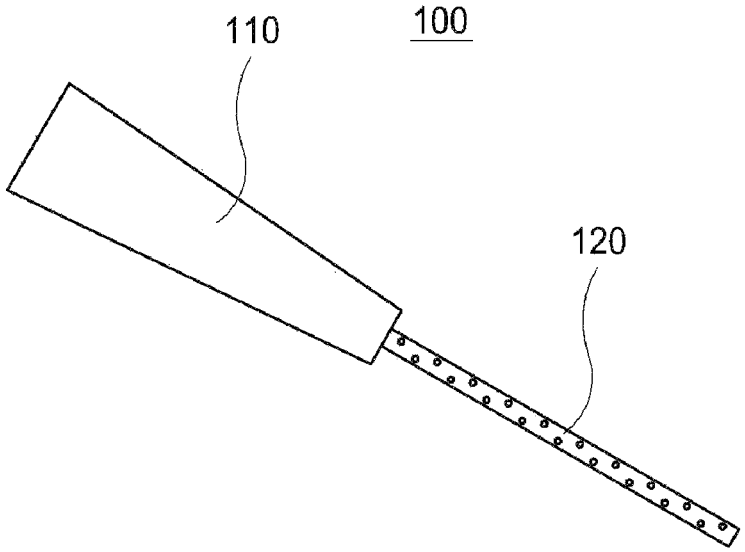
FIG. 10 is a side view of an expansion-type steel pipe according to an embodiment of the present invention.
Figure 11:
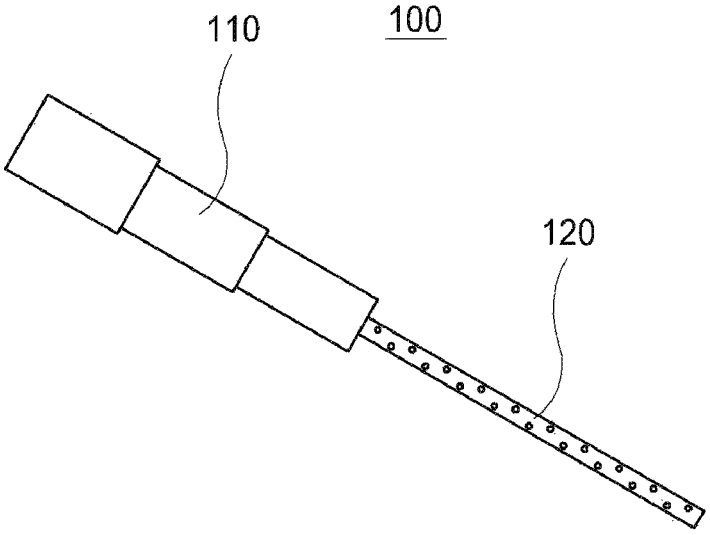
FIG. 11 is a side view of an expansion-type steel pipe according to another embodiment of the present invention.

In this case, as illustrated in FIGS. 10 and 11, since while the expansion-type steel pipe is expanded, the grout filled in the drilled hole is pushed to a rear end of the drilled hole by a geometric characteristic of the expansion-type steel pipe, the grout may be firmly filled in the drilled portion.

To fill the grout 200 in a gap between the drilled portion A and the ground reinforcement member 100, a grout injection pipe 210 is desirably coupled along an outer circumferential surface of the ground reinforcement member 100.

In this case, since the injection pipe 210 is coupled along the outer circumferential surface of the ground reinforcement member 100 up to an end of the settlement member 120, the grout 200 may be filled from the end of the settlement member 120.

To prevent the grout 200 from flowing to the outside of the drilled portion when the grout 200 is filled, a packing part 130 installed on the outer circumferential surface of the expansion-type steel pipe 110 to block an inlet of the drilled portion A is desirably further provided.

In this case, when the grout 200 is filled, the grout 200 may be prevented from flowing to the outside of the drilled portion A.

A through-hole 131 passing through the injection pipe 210 and a grout discharge hole 132 for checking the discharge of the grout 200 are desirably defined in the packing part 130.

In this case, since the packing part 130 is installed to block the inlet of the drilled portion A, when the grout 200 is completely filled in the drilled portion, the grout 200 is discharged through the discharge hole 132.

Accordingly, a degree of filling of the grout 200 is easily recognized.

The settlement member 120 is desirably made of a cable, steel fiber, high strength plastic, a steel bar, or a steel pipe.

In this case, since the settlement member 120 is installed in the rock layer 12 and fixed by the grout 200, the cable, the steel fiber, the high strength plastic, the steel bar, or the steel pipe may be used for the settlement member 120.

It is desirable that the settlement member 120 is made of a steel pipe, the grout introduction hole 121 is defined in the outer surface of the settlement member 120, and the grout 200 injected through the grout injection pipe 210 is filled in the drilled portion A and the outside of the combined ground reinforcement member 100 and also filled in an inside of the settlement member 120 through the introduction hole 121.

In this case, since the grout 200 is filled in the inside of the settlement member 120 including the introduction hole 121, the settlement member 120 may be further firmly fixed to the rock layer 12.

It is desirable that the settlement member 120 is made of a steel bar, and a screw 122 is provided along an outer circumferential surface of the steel bar.

Figure 3:
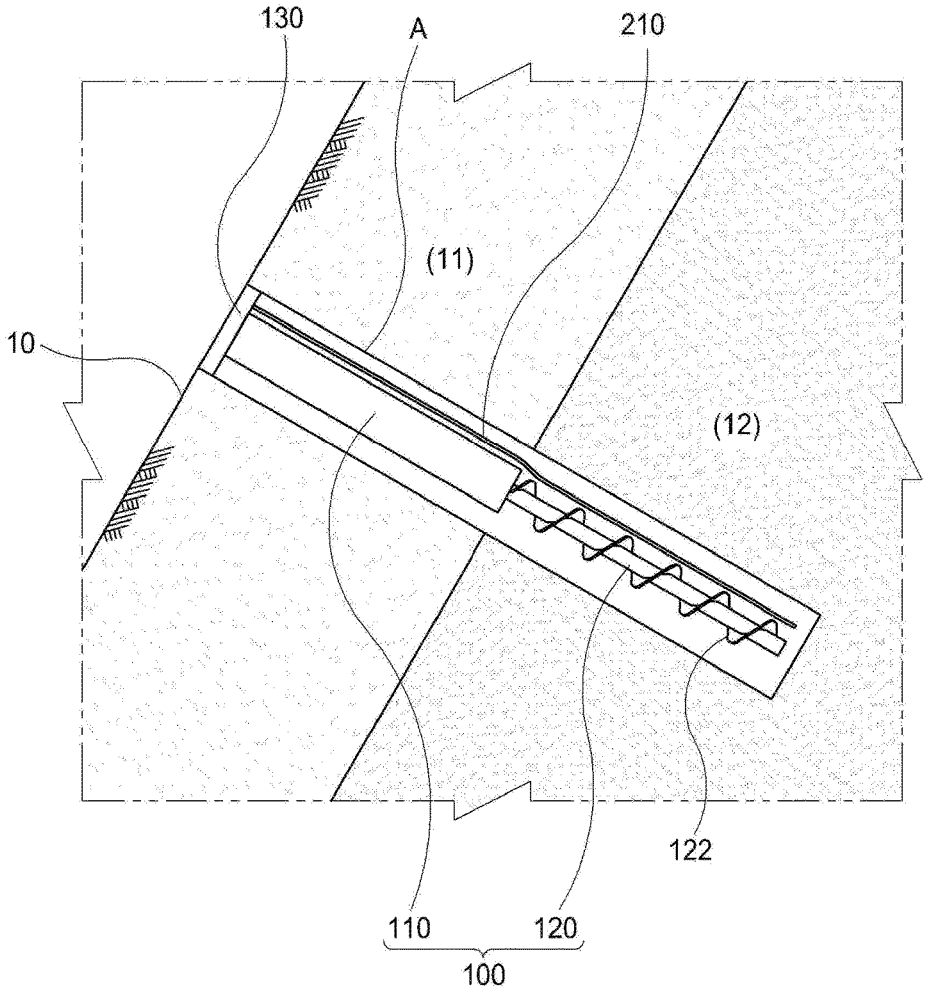
FIG. 3 is a side view illustrating a settlement member according to another embodiment of the present invention.
Figure 4:
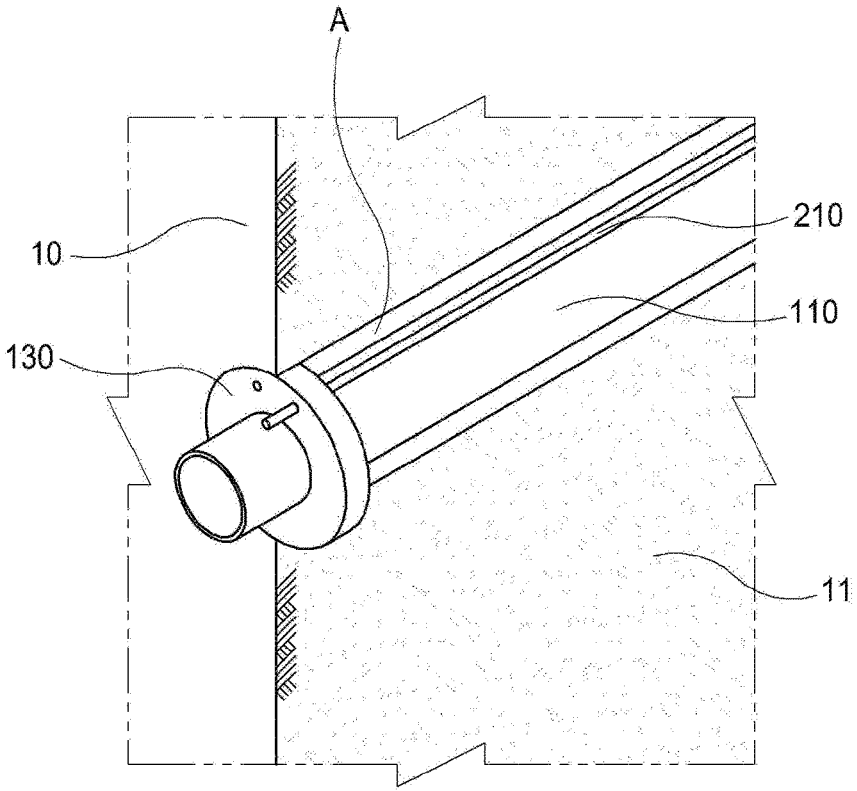
FIG. 4 is a perspective view illustrating an expansion-type steel pipe to which a packing part is coupled according to an embodiment of the present invention.
Figure 5:
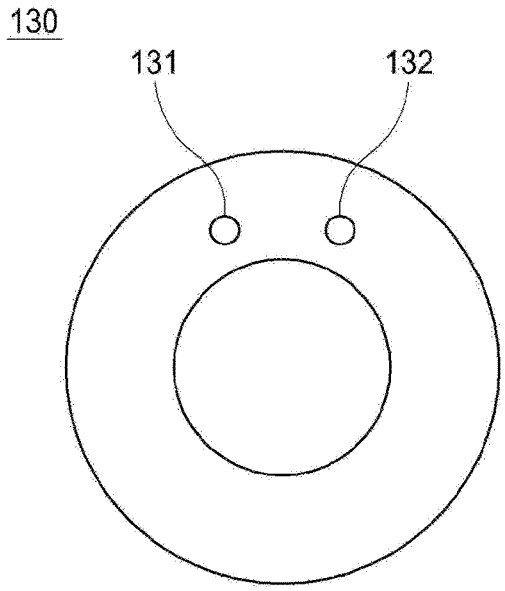
FIG. 5 is a cross-sectional view illustrating the packing part according to an embodiment of the present invention.
Figure 6:
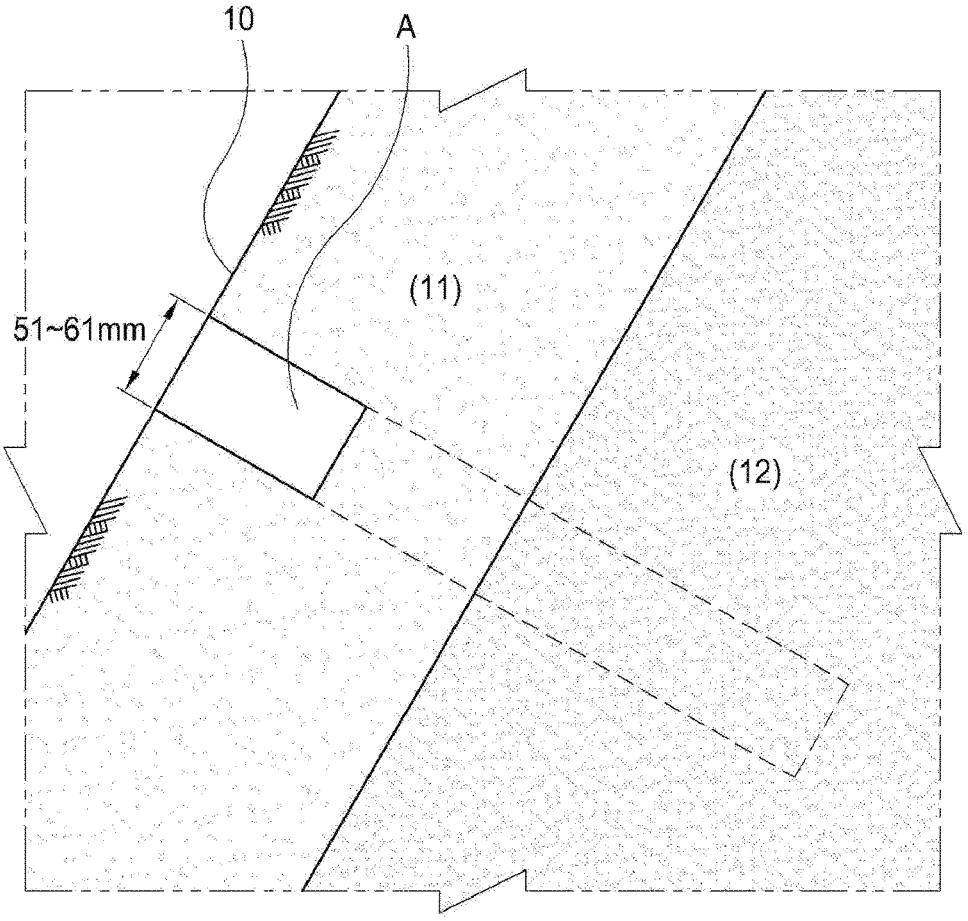
FIG. 6 is a process view illustrating a drilling process to have a small caliber according to an embodiment of the present invention.
Figure 7:
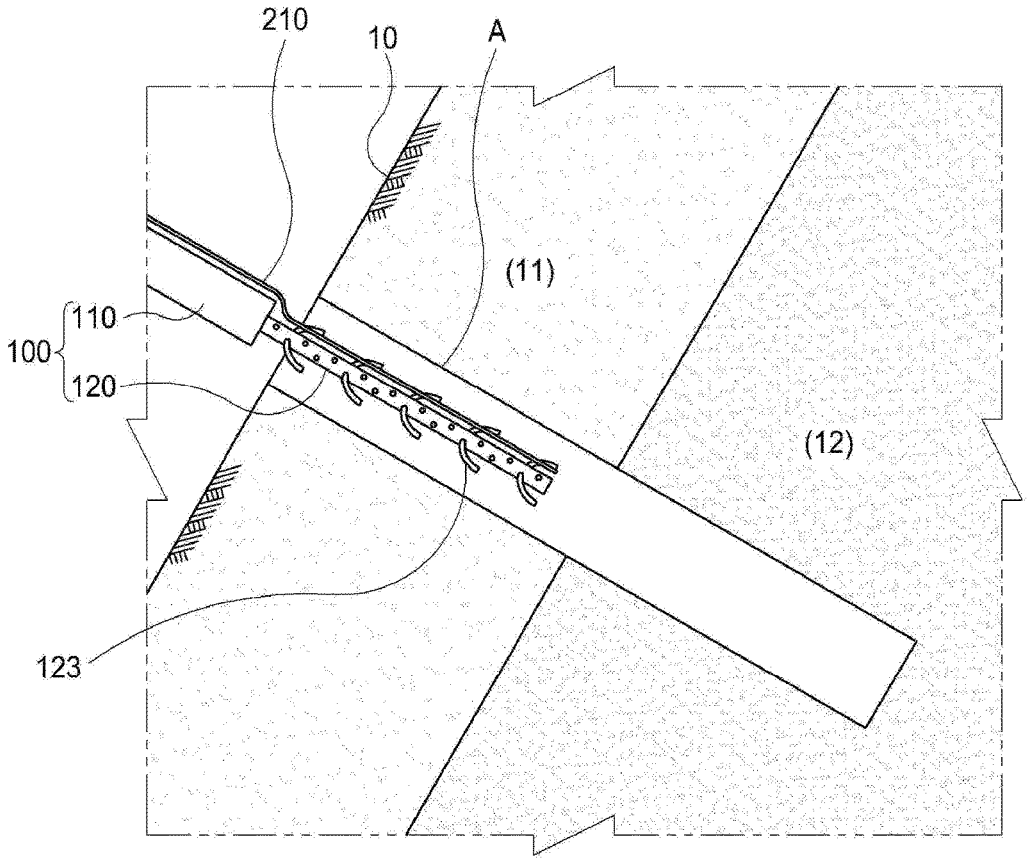
FIG. 7 is a process view illustrating an initial ground reinforcement member installation process according to an embodiment of the present invention.
Figure 8:
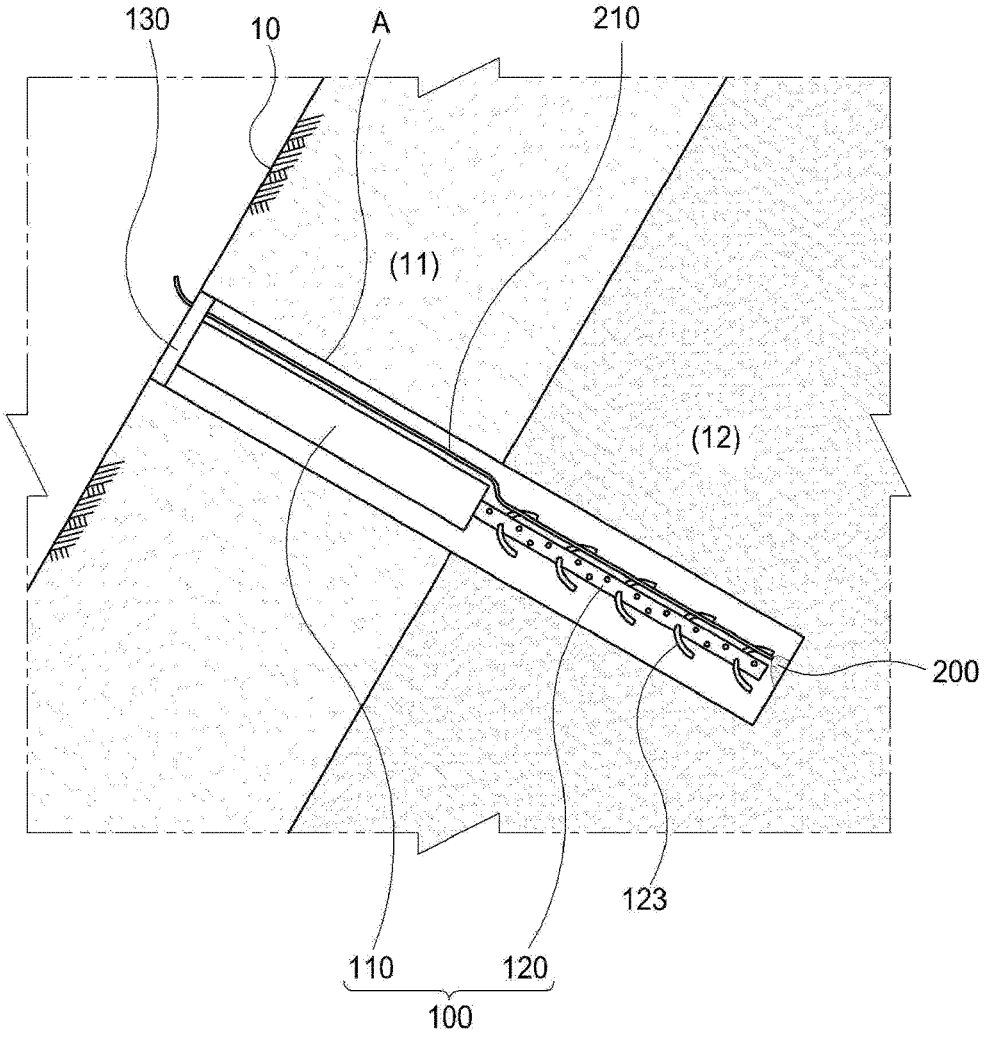
FIG. 8 is a process view illustrating a completed ground reinforcement member installation process according to an embodiment of the present invention.
Figure 9:
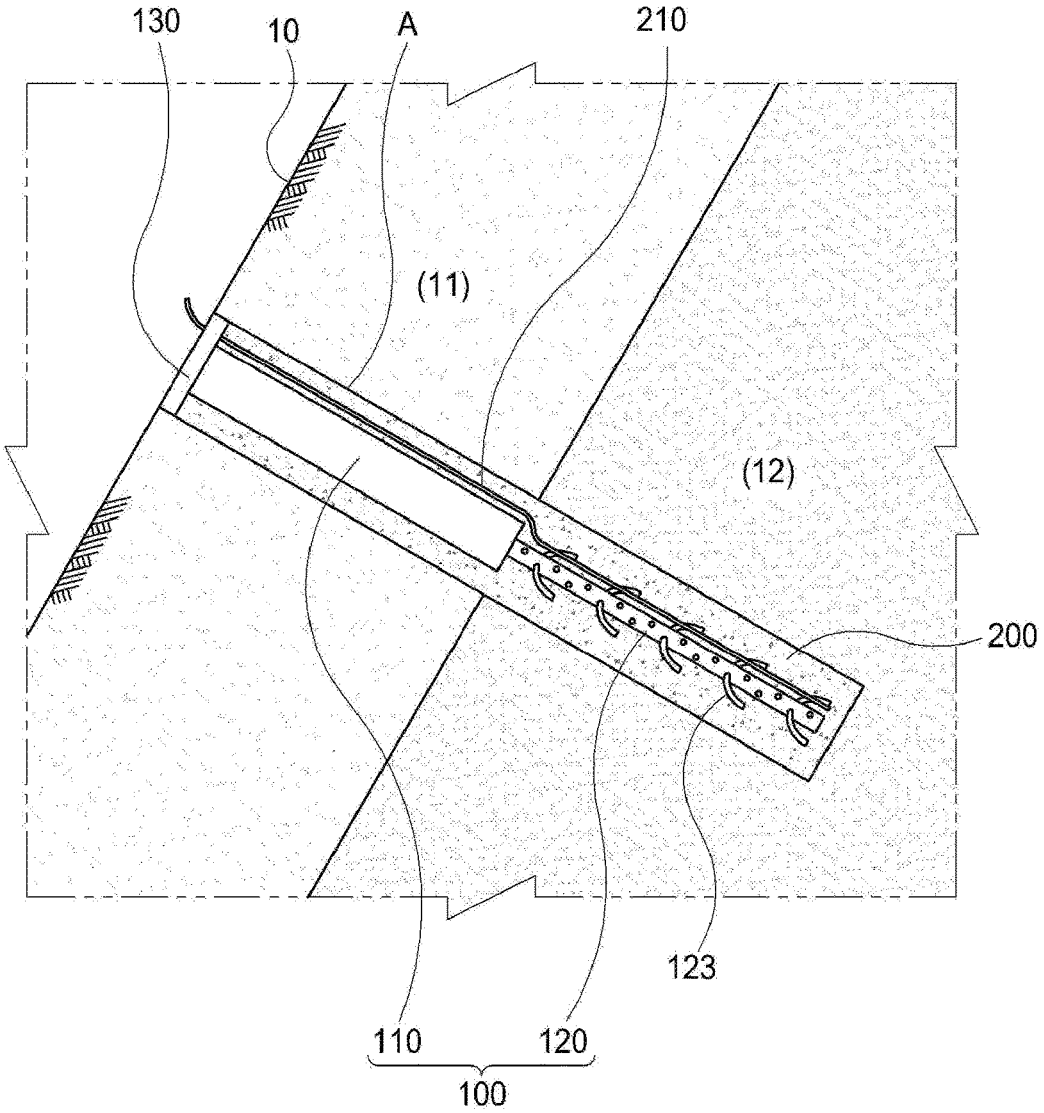
FIG. 9 is a process view illustrating a grout filling process according to an embodiment of the present invention.

In this case, since the screw 122 is provided along the outer circumferential surface of the settlement member 120 as illustrated in FIG. 3, coupling force between the grout 200 and the settlement member 120 may be improved after the grout 200 is filled.

According to an embodiment of the present invention, a method of installing the ground reinforcement structure includes: a ground drilling process of defining the drilled portion A having a diameter of 51 mm to 61 mm up to the rock layer 12; a ground reinforcement member installation process of installing the ground reinforcement member 100 to insert the settlement member 120 into the rock layer 12; a grout filling process of filling the grout 200 into the gap between the drilled portion A and the ground reinforcement member 100; and an expansion-type steel pipe expansion process of expanding the expansion-type steel pipe 110 by using hydraulic pressure.

In this case, the ground drilling process may drill the ground with the diameter of 51 mm to 61 mm to prevent the ground from being collapsed.

Also, since the ground reinforcement member 100 is installed in the drilled portion drilled up to the rock layer 12 and the grout 200 is filled therein, the coupling force between the rock layer 12 and the settlement member 120 is excellent.

According to another embodiment of the present invention, a method of installing the ground reinforcement structure includes: a ground drilling process of defining the drilled portion A having a diameter of 51 mm to 61 mm up to the rock layer 12; a ground reinforcement member installation process of installing the ground reinforcement member 100 to insert the settlement member 120 into the rock layer 12; a grout filling process of filling the grout 200 into the gap between the drilled portion A and the ground reinforcement member 100 and the inside of the settlement member 120; and an expansion-type steel pipe expansion process of expanding the expansion-type steel pipe 110 by using the hydraulic pressure.

In this case, since the expansion-type steel pipe 110 is expanded after the grout filling process, the grout filled in the inside of the drilled portion is further firmly filled.

According to the present invention, the ground reinforcement structure may have the drilled hole having the narrow diameter to prevent the weak sandy soil layer from being collapsed.

According to the present invention, since the ground reinforcement structure is fixed to the rock layer of the ground, on which the weak sandy soil layer is provided, the stiffness of the ground, on which the weak sandy soil layer is provided, may be improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A ground reinforcement structure installed on a ground (10) in which a sandy soil layer (11) having a weak surface layer is provided and thus large-caliber excavation is difficult to be performed, the ground reinforcement structure comprising a ground reinforcement member (100) comprising:

an expansion-type steel pipe (110) inserted to be installed in a small-caliber drilled portion (A), wherein the small-caliber drilled portion (A) having a diameter of 51 mm to 61 mm and expanded by hydraulic pressure; and a settlement member (120) coupled to a rear end of the expansion-type steel pipe (110), wherein the expansion-type steel pipe (110) is inserted into the sandy soil layer (11), and the settlement member (120) is inserted into a rock layer (12), wherein a grout injection pipe (210) is coupled along an outer circumferential surface of the ground reinforcement member (100) to fill grout (200) into a gap between the drilled portion (A) and the ground reinforcement member (100), wherein the ground reinforcement structure further comprises a packing part (130) installed on an outer circumferential surface of the expansion-type steel pipe (110) to block an inlet of the drilled portion (A) to prevent the grout (200) from flowing to the outside of the drilled portion while the grout (200) is filled, wherein the packing part (130) comprises: a through-hole (131) through which the injection pipe (210) passes; and a grout discharge hole (132) for checking discharge of the grout (200) that is completely filled, wherein the settlement member (120) is made of a steel pipe, a grout introduction hole is defined in an outer circumferential surface of the settlement member (120), and the grout (200) injected through the grout injection pipe (210) installed along the outer circumferential surfaces of the expansion-type steel pipe (110) and the settlement member (120) is filled in the drilled portion (A) and an outside of the combined ground reinforcement member (100), and filled in an inside of the settlement member (120) through the introduction hole (121).

2. The ground reinforcement structure of claim 1, wherein the settlement member (120) further comprises a pair of horseshoe-type shear reinforcement members (123) passing through the introduction hole (121) and coupled to each other to improve coupling force between the settlement member (120) and the grout (200).

3. A method of installing the ground reinforcement structure, wherein a ground reinforcement structure is installed on a ground (10) in which a sandy soil layer (11) having a weak surface layer is provided and thus large-caliber excavation is difficult to be performed, and the ground reinforcement structure comprising a ground reinforcement member (100) comprises: an expansion-type steel pipe (110) inserted to be installed in a small-caliber drilled portion (A), wherein the small-caliber drilled portion (A) having a diameter of 51 mm to 61 mm and expanded by hydraulic pressure; and a settlement member (120) coupled to a rear end of the expansion-type steel pipe (110), wherein the expansion-type steel pipe (110) is inserted into the sandy soil layer (11), and the settlement member (120) is inserted into a rock layer (12), wherein a grout injection pipe (210) is coupled along an outer circumferential surface of the ground reinforcement member (100) to fill grout (200) into a gap between the drilled portion (A) and the ground reinforcement member (100), wherein the ground reinforcement structure, further comprises a packing part (130) installed on an outer circumferential surface of the expansion-type steel pipe (110) to block an inlet of the drilled portion (A) to prevent the grout (200) from flowing to the outside of the drilled portion while the grout (200) is filled, wherein the packing part (130) comprises: a through-hole (131) through which the injection pipe (210) passes; and a grout discharge hole (132) for checking discharge of the grout (200) that is completely filled, wherein the settlement member (120) is made of a steel pipe, a grout introduction hole is defined in an outer circumferential surface of the settlement member (120), and the grout (200) injected through the grout injection pipe (210) installed along the outer circumferential surfaces of the expansion-type steel pipe (110) and the settlement member (120) is filled in the drilled portion (A) and an outside of the combined ground reinforcement member (100), and filled in an inside of the settlement member (120) through an introduction hole (121), the method comprising:

a ground drilling process of defining the drilled portion (A) having a diameter of 51 mm to 61 mm up to the rock layer (12);

a ground reinforcement member installation process of installing the ground reinforcement member (100) to insert the settlement member (120) into the rock layer (12);

a grout filling process of filling the grout (200) into a gap between the drilled portion (A) and the ground reinforcement member (100) and the inside of the settlement member (120); and an expansion-type steel pipe expansion process of expanding the expansion-type steel pipe (110) by using hydraulic pressure.

4. A method of installing the ground reinforcement structure, wherein a ground reinforcement structure is installed on a ground (10) in which a sandy soil layer (11) having a weak surface layer is provided and thus large-caliber excavation is difficult to be performed, and the ground reinforcement structure comprising a ground reinforcement member (100) comprises: an expansion-type steel pipe (110) inserted to be installed in a small-caliber drilled portion (A), wherein the small-caliber drilled portion (A) having a diameter of 51 mm to 61 mm and expanded by hydraulic pressure; and a settlement member (120) coupled to a rear end of the expansion-type steel pipe (110), wherein the expansion-type steel pipe (110) is inserted into the sandy soil layer (11), and the settlement member (120) is inserted into a rock layer (12), wherein a grout injection pipe (210) is coupled along an outer circumferential surface of the ground reinforcement member (100) to fill grout (200) into a gap between the drilled portion (A) and the ground reinforcement member (100), wherein the ground reinforcement structure, further comprises a packing part (130) installed on an outer circumferential surface of the expansion-type steel pipe (110) to block an inlet of the drilled portion (A) to prevent the grout (200) from flowing to the outside of the drilled portion while the grout (200) is filled, wherein the packing part (130) comprises: a through-hole (131) through which the injection pipe (210) passes; and a grout discharge hole (132) for checking discharge of the grout (200) that is completely filled, wherein the settlement member (120) is made of a steel pipe, a grout introduction hole is defined in an outer circumferential surface of the settlement member (120), and the grout (200) injected through the grout injection pipe (210) installed along the outer circumferential surfaces of the expansion-type steel pipe (110) and the settlement member (120) is filled in the drilled portion (A) and an outside of the combined ground reinforcement member (100), and filled in an inside of the settlement member (120) through an introduction hole (121), wherein the settlement member (120) further comprises a pair of horseshoe-type shear reinforcement member (123) passing through the introduction hole (121) and coupled to each other to improve coupling force between the settlement member (120) and the grout (200), the method comprising:

a ground drilling process of defining the drilled portion (A) having a diameter of 51 mm to 61 mm up to the rock layer (12);

a ground reinforcement member installation process of installing the ground reinforcement member (100) to insert the settlement member (120) into the rock layer (12);

a grout filling process of filling the grout (200) into a gap between the drilled portion (A) and the ground reinforcement member (100) and the inside of the settlement member (120); and an expansion-type steel pipe expansion process of expanding the expansion-type steel pipe (110) by using hydraulic pressure.

* * * * *